US008549783B2

(12) United States Patent
Marquez

(10) Patent No.: US 8,549,783 B2
(45) Date of Patent: Oct. 8, 2013

(54) TACTICAL APPARATUS AND METHOD FOR MOUNTING A MULTI-CARTRIDGE FIRING ELECTRIC DISCHARGE WEAPON

(76) Inventor: Mitchel M. Marquez, Sacramento, CA (US)

( * ) Notice: Subject to any disclaimer, the term of this patent is extended or adjusted under 35 U.S.C. 154(b) by 8 days.

(21) Appl. No.: 13/026,288

(22) Filed: Feb. 13, 2011

(65) Prior Publication Data

US 2011/0198471 A1 Aug. 18, 2011

Related U.S. Application Data

(60) Provisional application No. 61/304,433, filed on Feb. 13, 2010.

(51) Int. Cl.
*F41C 23/12* (2006.01)

(52) U.S. Cl.
USPC ..... 42/71.01

(58) Field of Classification Search
USPC ..... 42/71.01–73, 1.08, 84, 85, 1.14, 106; 89/1.11; 361/232
See application file for complete search history.

(56) References Cited

U.S. PATENT DOCUMENTS 2,495,977 A * 1/1950 Madsen ..... 42/71.01
4,271,623 A 6/1981 Beretta
4,788,785 A * 12/1988 White ..... 42/72
5,092,070 A 3/1992 Perkins
5,103,366 A 4/1992 Battochi
5,711,102 A * 1/1998 Plaster et al. ..... 42/71.01
5,778,588 A 7/1998 Allen, IIII et al.
6,318,014 B1 * 11/2001 Porter ..... 42/72
7,409,912 B2 * 8/2008 Cerovic et al. ..... 102/502
7,552,557 B1 * 6/2009 Mabry ..... 42/72
2005/0115140 A1 * 6/2005 Little ..... 42/118
2005/0188593 A1 * 9/2005 Cerovic et al. ..... 42/77
2006/0064913 A1 * 3/2006 Gablowski et al. ..... 42/72

FOREIGN PATENT DOCUMENTS

WO WO/2006/093522 9/2006

* cited by examiner

*Primary Examiner* — Michael Carone
*Assistant Examiner* — Reginald Tillman, Jr.
(74) *Attorney, Agent, or Firm* — Law Offices of David M. Lang; David M. Lang

(57) ABSTRACT

Embodiments include an apparatus having a frame, at least one handle, a control housing, and a mounting plate wherein a plurality of firing cartridges from a multi-cartridge electric discharge weapon may mounted on the mounting plate, permitting an available multi-cartridge electric discharge weapon to be converted from a fixed or vehicle mounted position to a hand-carried position where it may be carried, aimed, and fired as a conventional weapon. Certain embodiments disclose a rail system permitting handles and accessories to be mounted thereupon and used in conjunction with the mounted electric discharge weapon. A method for converting a multi-cartridge firing electrical discharge weapon from a fixed or vehicle-mounted status to a hand-carryable status.

1 Claim, 7 Drawing Sheets

TACTICAL APPARATUS AND METHOD FOR MOUNTING A MULTI-CARTRIDGE FIRING ELECTRIC DISCHARGE WEAPON

CROSS REFERENCE TO RELATED APPLICATIONS

The application claims 35 U.S.C. §119(e), to U.S. Provisional Application 61/304,433 filed Feb. 13, 2010, entitled "TACTICAL APPARATUS AND METHOD FOR MOUNTING A MULTI-CARTRIDGE FIRING ELECTRIC DISCHARGE WEAPON" which is currently pending and incorporated by reference into this application as if fully set forth herein.

FIELD OF THE INVENTION

The field of the present invention relates to apparatus for mounting an electric discharge weapon, generally, and more specifically to a handheld apparatus for mounting a free-standing stationary or vehicle-mounted incapacitating device, which permits the mounted incapacitating device to be carried, aimed, and fired in a manner similar to a conventional firearm.

BACKGROUND

Less-lethal methods for subduing dangerous and potentially dangerous subjects are desirable alternatives for law enforcement, security, corrections officers, and military personnel. In addition to conventional firearms, less-lethal methods, such as stun-guns, are often deployed by a military unit, law enforcement department, or corrections staff to broaden available options to subdue violent or dangerous subjects. Some prior art electric discharge weapons require physical contact to deliver an electric arc between two electrodes, which produces significant localized pain when placed in physical contact with a subject. Other electric discharge weapons, such as handheld TASER brand units, fire dart-like electrodes from a handheld apparatus, wherein the darts are tethered to wires which remain electrically connected to the handheld apparatus. The dart-like electrodes are pointed and barbed to penetrate clothing and remain in place after contact with the subject. Electrical current from the handheld apparatus and is delivered to the subject resulting in neuromuscular incapacitation which transiently disrupts normal neuromuscular functioning permitting the subject to be more-safely subdued.

Relatively recently, as alternatives to hand-held electric discharge weapons, free-standing stationary units having a single or multiple array of firing cells or cartridges have been described. Because they fire several shots simultaneously, multi-cartridge electric discharge weapons may be particularly useful to protect an area, provide crowd control, or employed in specialized situations such as riot control. Additionally, multi-cartridge electric discharge weapons may be useful in correctional facilities to control a variety of commonly-encountered events such as containing violent subjects, controlling violent prison yard fights involving multiple combatants, and subduing subjects armed with a weapon under circumstances where deadly force is not authorized. Additionally, the use of multi-cartridge firing units, mounted on a vehicle, such a police vehicle, has been described as well. Without doubt, stationary and vehicle-mounted multi-cartridge electric discharge weapons offer law enforcement personnel valuable options.

In some cases, however, it may be advantageous to quickly move the system from a fixed status to a mobile hand-carried status. For example, moving the system may be required where a tactical decision is made to redefine an area of protection, or where hostile subjects are too numerous or too dispersed for effective utilization. Additionally, in some cases, it may be necessary to rapidly move such a system to prevent hostile subjects from acquiring control of the device. Furthermore, where the attendant tactical circumstances require, is desirable to provide law enforcement personnel with an option to rapidly convert a stationary or vehicle-mounted system into a system which may be hand-carried, moved, and fired. Moreover, in some circumstances a stationary or vehicle mounted system does not provide adequate targeting accuracy. Human control of a multi-cartridge electrical discharge weapon may permit a more refined, efficient, and safe application of force. Further, human control of a multi-cartridge electrical discharge weapon will serve as a force-multiplier—allowing a single user to subdue a relatively large number of hostile subjects. Additionally, there are applications to use a hand-held multi-cartridge electrical discharge weapon in circumstances involving a single subject. A single cartridge weapon requires that both electrodes make sufficient contact with the subject to complete the circuit and subdue the subject. In contrast, a hand held multi-cartridge electrical discharge weapon (which can by example, file 12 electrodes) dramatically increases the probability that at least two of the electrodes will make sufficient contact to subdue the subject.

SUMMARY

One aspect of the present invention permits a stationary electric discharge weapon system to be quickly mounted on a hand-held apparatus permitting the system to be transported, aimed, and fired where it is tactically advantageous. Another aspect of certain embodiments of the present invention provides an apparatus which is customizable and allows the use of varied accessory equipment on the apparatus in conjunction with an electric discharge weapon. Further aspects of the present invention allow stationary or vehicle-mounted systems to be more versatilely deployed and utilized by law enforcement personnel and others. Another aspect of the invention discloses an apparatus which permits a user to hold, carry, and fire the apparatus as one would a conventional rifle. Another aspect of the invention discloses a method for converting a fixed multi-cartridge electric discharge weapon to a hand-held status.

DETAILED DESCRIPTION

Figure 1:
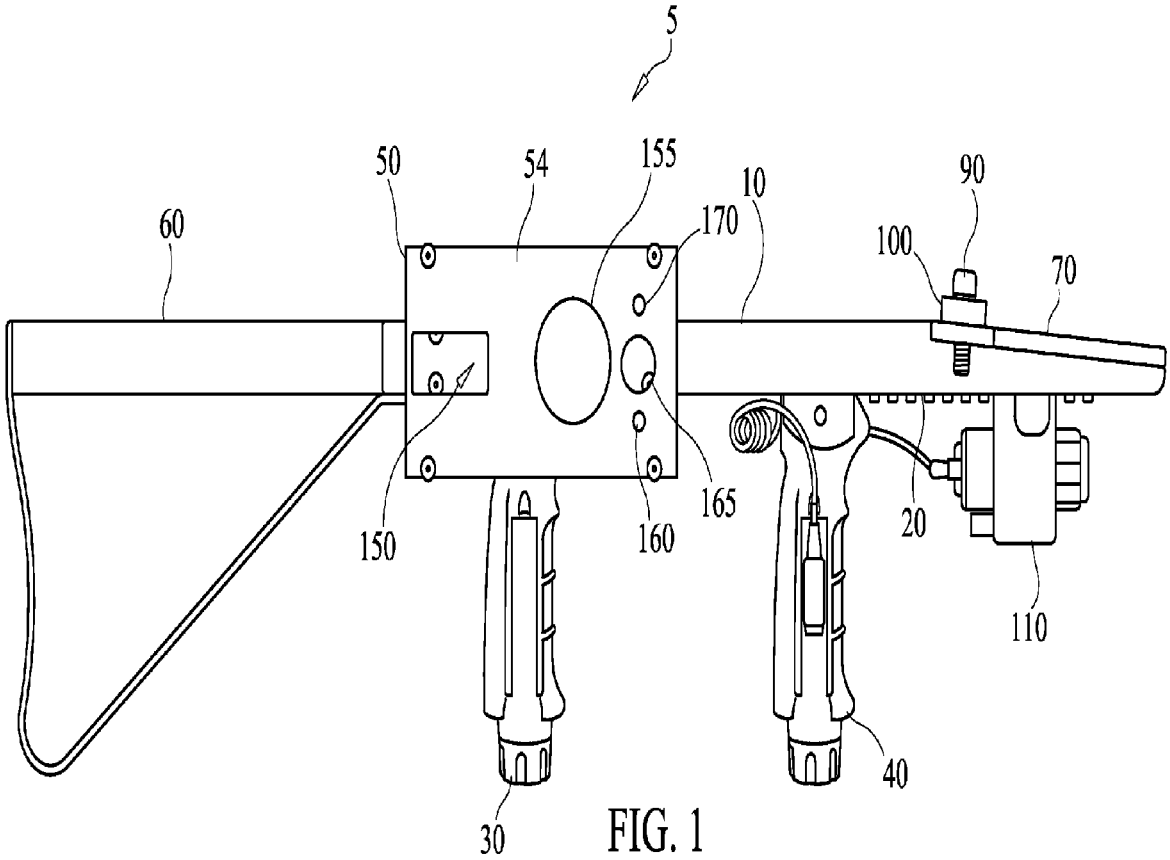
FIG. 1 illustrates a side elevation view of an embodiment of the present invention.
Figure 2:
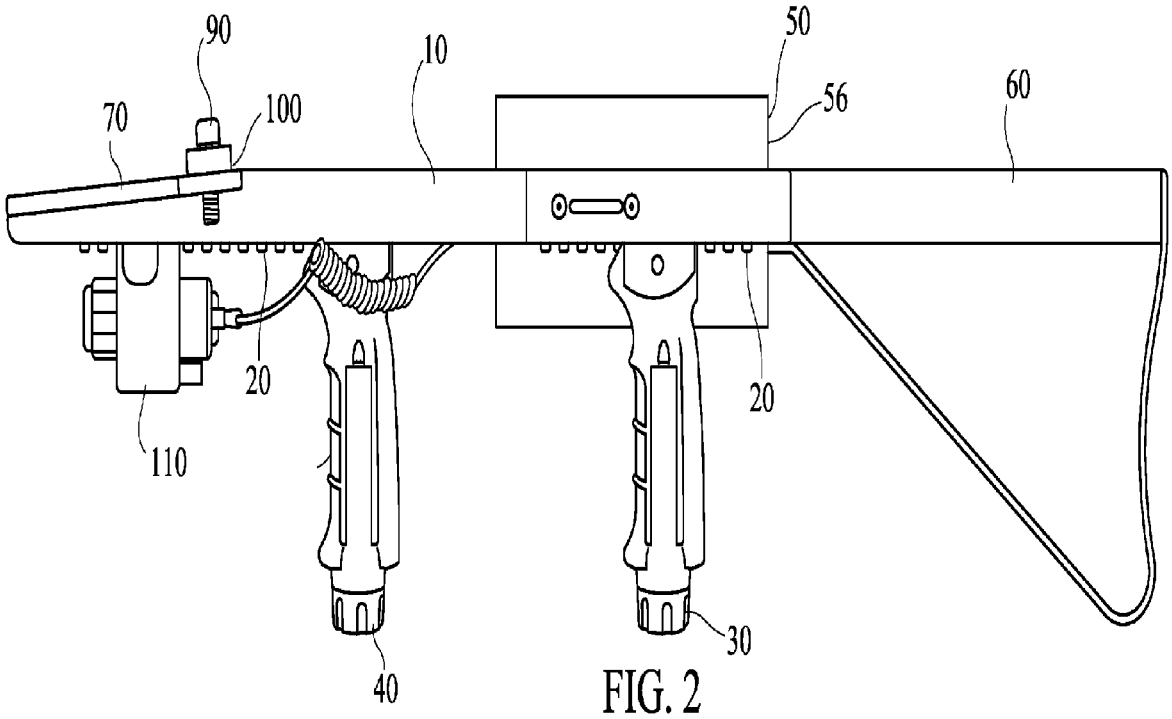
FIG. 2 illustrates a side elevation view of an embodiment of the present invention.
Figure 3:
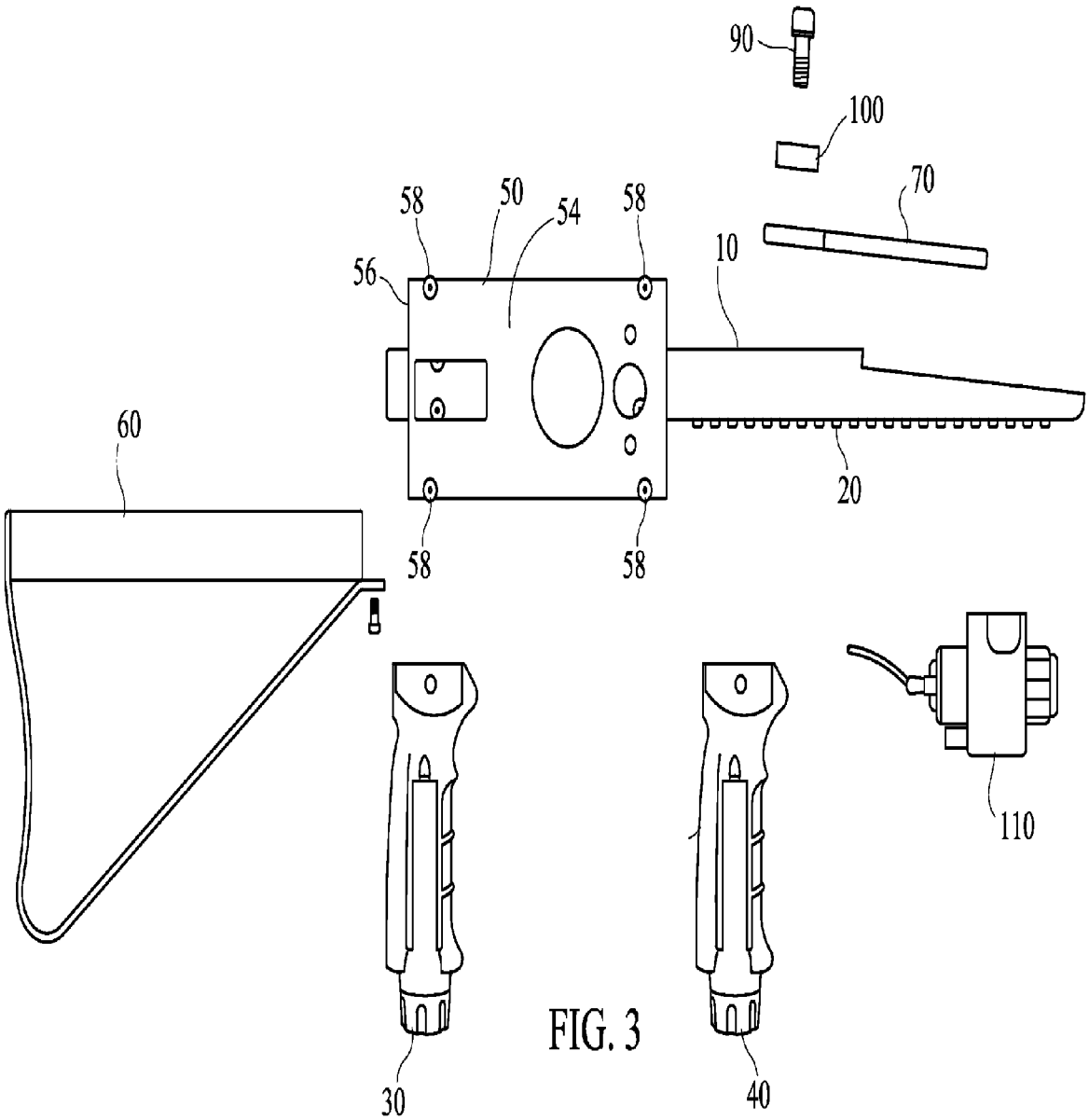
FIG. 3 illustrates an exploded elevation view of an embodiment of the present invention.

Turning now to the illustrations, FIGS. 1 and 2 illustrate apparatus 5 which has a main frame 10 that in one embodiment, may be comprised of solid material such as metal, plastic, urethane, or other relatively firm material. In another embodiment frame 10 may be hollow or partially hollow. In one embodiment, frame 10 may be shaped to define a rail mounting system 20, such as a Picatinny-style rail system. Alternatively, rail system 20 may be formed independently from the frame and attached thereto by, for example, welding, adhesive, and mechanical affixation with screws, rivets, and the like. Rail system, 20 may be standardized to well-known rail system dimensions such as Picatinny or Weaver spacing dimensions, or may be customized to accommodate any dimensions. Rail system 20 may also be standardized to military specifications for weapons using "Mil-spec" components. Rail system 20 is spaced to allow the user to slide off and remove accessories without disassembly of the entire apparatus.

In one embodiment, a machined rail system 20 may permit first handle 30 to be rapidly attached and detached to frame 10 and moved horizontally along frame 10 to suit the user's positioning preference. Second handle 40, may be similarly attached to frame 10. Electric discharge weapon fire control housing 50 is mounted on a recessed portion of frame 10 shaped to accommodate control housing 50, as illustrated by FIGS. 1-5. In one embodiment, fire control housing 50 has a body 52 affixed to frame 10 and a fire control housing cover 54 reversibly affixed to said body 52. In one embodiment, cover may be affixed to housing body 52 by countersunk screws, or may be snap fit. Cover 54 may be removed to expose the inner surface of fire control housing body 52. It should be noted that in another embodiment, control housing may be located elsewhere on the frame.

A fire control unit from an available stationary electric discharge weapon system, such as the Taser SHOCKWAVE, may placed within fire control housing body 52 and secured when housing cover 54 is reattached. It should be noted that various mechanisms to couple an available fire control unit to apparatus 5 are recognized. In an alternative embodiment, frame 10 may shaped to define a receptacle to accommodate an available fire control unit, which may be slidably fit within. In another embodiment, available fire control unit may be clampably secured. In yet another embodiment, an available fire control unit may be reversibly coupled by a quick connect coupler. In another embodiment, fire control unit may be secured within a modified stock 60. In another embodiment, as illustrated by FIG. 6, an electric discharge weapon, such as the SHOCKWAVE, is provided with a multi-strand wire having threadable couplings on both ends; one end is threadably coupled to the housing containing the multiple firing cartridges, the second end is coupled to the apparatus instead of the fire control unit. The weapon may then be fired by trigger actuation. In one embodiment, illustrated by FIG. 5 a handle exists opposite housing 50 to accommodate a sling.

In one embodiment, the apparatus is tailored to correspond to the SHOCKWAVE fire control unit manufactured by Taser Inc. specifically. When the SHOCKWAVE fire control unit is inserted and fully enclosed within control housing 50, apertures in housing 50 corresponding to the SHOCKWAVE switches, buttons, and indicator lamps, wherein switches allow the SHOCKWAVE's switches, buttons, and lamps to be accessible and/or visible to the user. In one embodiment, housing cover 54 is shaped to define apertures including the safety arming switch aperture 150, fire button aperture 155, which correspond to the switches and buttons of the SHOCKWAVE firing control unit specifically. Likewise, cover 54 includes a "charge" aperture 160, "re-energize" aperture 165, and "go" aperture 170 corresponding indicator lights of the SHOCKWAVE fire control unit specifically.

Stock 60 is mounted to the proximal end of frame 10, and in one embodiment may be affixed by screw. In other embodiments, stock 60 may be maintained in position through a variety of other methods including a spring peg engaging an aperture, friction fit, or a by detent locking mechanism. In one embodiment, stock 60 may be foldable or collapsible, and in another embodiment, stock 60 may be detachable; folding or collapsible stock solutions are well known and described in the prior art. In one embodiment, stock 60 may be affixed by a single fastener to allow a user to slide the stock off quickly by removing the single fastener. In another embodiment, stock 60 may be folded to the left or right side to allow the user to shorten the overall length of apparatus 5, which may be particularly useful when used in a confined space. In one embodiment, stock 60 may be omitted which shortens the overall length of the apparatus.

Figure 4:
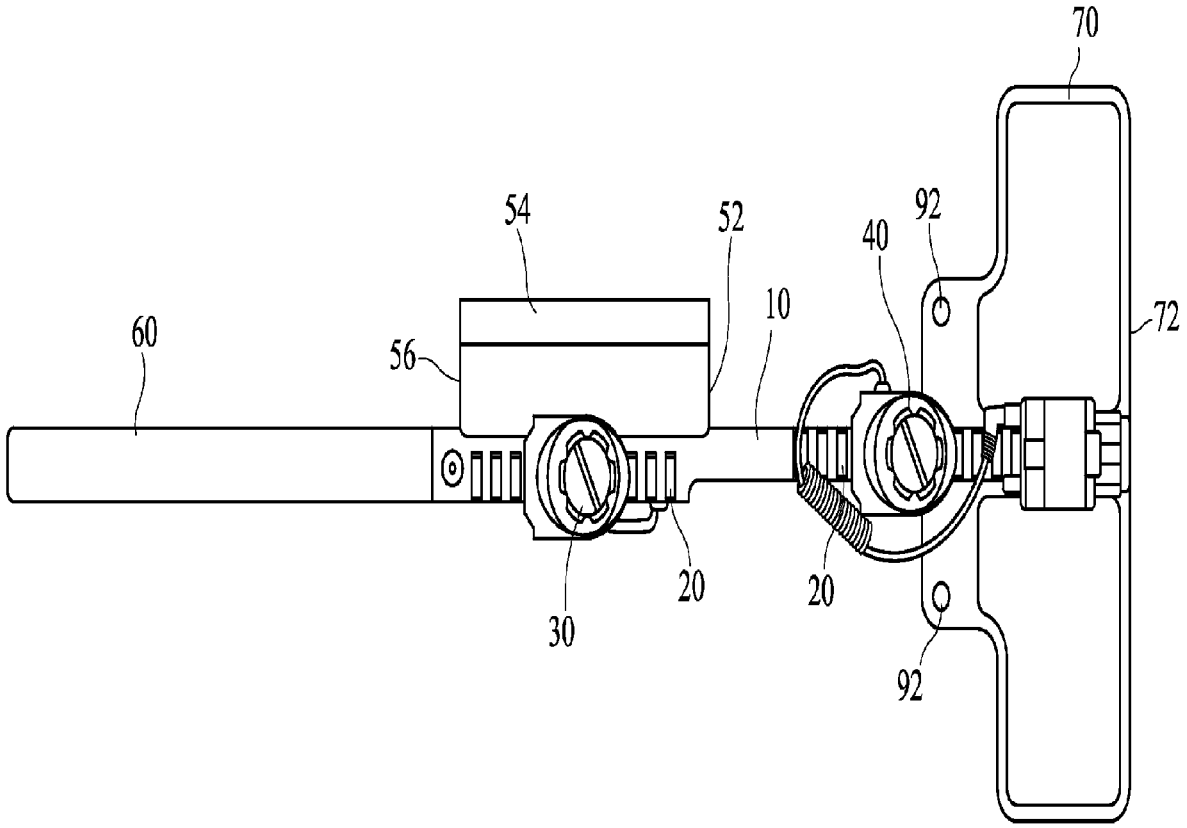
FIG. 4 illustrates a bottom view of an embodiment of the present invention, with handles attached.
Figure 5:
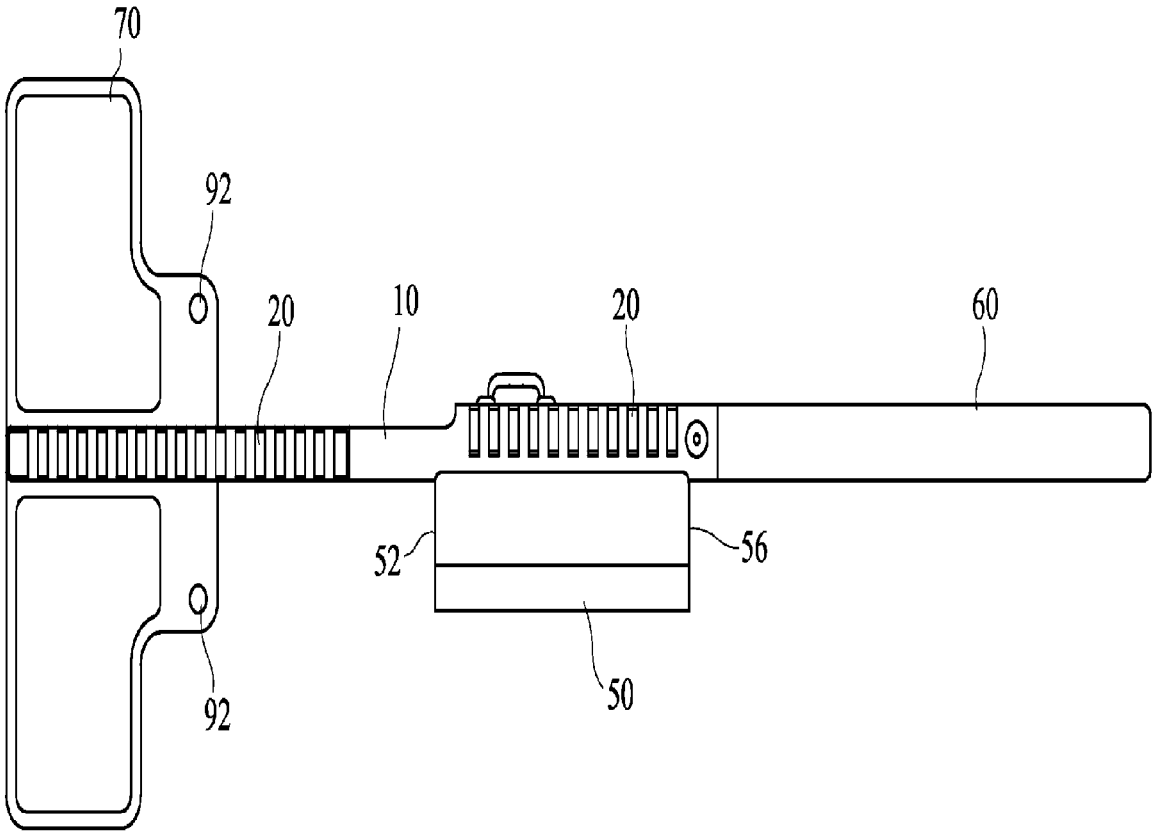
FIG. 5 illustrates a bottom view of an embodiment of the present invention with handles removed.
Figure 6:
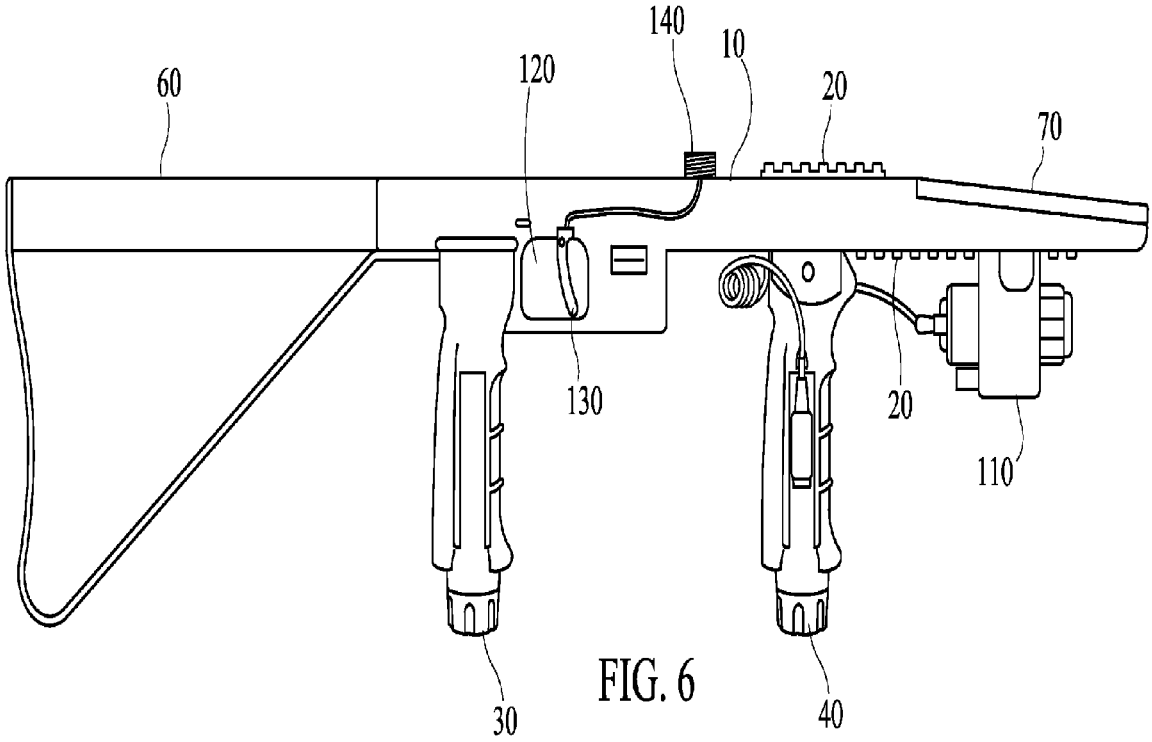
FIG. 6 illustrates a side elevation view of an embodiment of the present invention.

As seen by FIGS. 4 and 5, at the distal end of frame 10, mounting plate 70 is disposed on the top surface of frame 10. An available aggregate array of cartridges, such as the Taser SHOCKWAVE system, may be mounted on mounting plate 70. The mounting plate 70 may be varied in shape; in one embodiment, mounting plate 70 has a straight terminal aspect 72. In an alternative embodiment, mounting plate 70 may have an arcuate terminal aspect. Varied shapes of the mounting plate may be useful in accommodating different array orientation. For example, an arcuate mounting plate 72 may accommodate an array of firing cartridges oriented in a convex orientation (relative to the subject) which will result in an increase in dart spread when the system is actuated. In another embodiment, an arcuate mounting plate may have a concave orientation relative to the subject which will result in an increase of dart concentration toward the subject. In one embodiment, mounting plate 70 may be screwably affixed to the top surface of frame 10 through countersink fasteners passing through two countersink apertures 14 in frame 10. In one embodiment, the bottom of the plate 70 is shaped to define a recess to accommodate the relatively terminal top portion of frame 10. In other embodiments, mounting plate 70 may be affixed by welding, adhesive, or other means, and in another embodiment, mounting plate 70 is integrally formed with frame 10.

In one embodiment, the terminal end 80 of frame 10 is sloped downwardly. In another embodiment, terminal end 80 of frame 10 may be shaped to without a slope, and in still another embodiment end 80 may be sloped upwardly. The difference in slope of end 80, and mounting plate 70, will determine the flight angle—i.e. flight path of the dart relative to the ground. This may be customized to achieve the desired dart trajectory when an attached electric discharge weapon system is actuated with the apparatus is held in a comfortable firing position. The desired slope of the distal end of frame 10 depends on variables such as the height of the user as well as subject distance and desired location for the darts to strike the subject's body. In one preferred embodiment, mounting plate 70 is downwardly sloped 4 degrees was found to be useful.

In one embodiment, where an available aggregate array or firing cartridges contained has an array housing, with a mounting bracket attached to the housing, the mounting bracket may be boltably affixed to the mounting plate 70 by bolt 90 passing through mounting aperture 92 on plate 70. Bolt 90 may pass through annular spacer 100 which is utilized to secure the array, and may be comprised of a resilient material to absorb shock, provide vibration control, and permit snug affixation between an available multi-cartridge array and plate 70. In one embodiment spacer 100 may be comprised of plastic, or an improved plastic polymer material such as polyoxymethylene—DELRIN.

Apparatus 5 is customizable and capable of receiving various attachments. For example, an optional accessory 110 may be affixed to at least a portion of rail system 20. Such accessories commonly can include a light, laser targeting system, or camera, or other equipment typically used in conjunction with law enforcement or hand-held weapon systems. In one embodiment, illustrated by FIG. 6, rail system 20 may be located on the top of frame 10. The rail system may be any number an on any location and length on frame 10. Optional equipment such as video recording devices, audio recording devices, sighting systems, and lighting systems, and the like, may be placed on the top of apparatus 5. Accessories 110 having a coupling surface are slid on the rail system and locked in a fashion well known in the prior art. Various locking means may be employed to maintain the accessory 110 in a fixed position relative to rail system 20 including but not limited to thumbscrews, "rail grabbers" levers, or clamped onto slots between the raised section of the rail.

In an alternative embodiment illustrated by FIG. 6, frame 10 is shaped to define a trigger well 120 and trigger 130. An electrical coupling point 140 is electrically connected to trigger 130. In this embodiment, the fire control unit, or components comprising the fire control unit are located within a hollow portion of the apparatus, which may include frame 10 or stock 60. This embodiment permits the apparatus to be trigger-fired as a conventional firearm. In another embodiment, a data downloading port allows an armorer technician to service and troubleshoot the weapons system, record use data, and measure battery life.

It will be recognized that variations in the composition of frame 10, fire control box 50, mounting plate 70, rail system 20, and stock 60, such as size, shape, and relative dimensions are possible and anticipated as included in the present invention. Further, while some embodiments herein are disclosed as components assembled together, the present invention may be integrally formed. For example one or more elements such as stock 60, frame 10, mounting plate 70, handles 30 and/or 40, and control box 50 may be integrally formed by, for example, thermoplastic injection molding or by an extrusion process.

In use, an available stationary or vehicle-mounted electric discharge weapon, such as the SHOCKWAVE manufactured by Taser, Incorporated, may be decoupled from any support legs or, where coupled to a vehicle, removed the vehicle. Fire control housing cover 54 is uncoupled from fire control housing body 52 and the available fire control unit may be placed within. Cover 54 may be replaced and fastened closed. Thumb access to the fire control unit's fire button may be achieved through aperture 155 in of cover 54.

The available aggregate array of firing cartridges may be placed on spacer 100 and mounting plate 70 and fastened thereupon—in one embodiment bolt 90 passes though the array housing of an available array and screwably affixes the array housing to mounting plate 70.

The user may carry apparatus 5 as a conventional weapon using first handle 30 and second handle 40. To discharge the weapon, the user aims the weapon in a conventional manner, removes the thumb from first handle 30 and depresses the fire control unit's actuation button to discharge the system.

The stationary or vehicle-mounted system may be decoupled from the apparatus in a similar reverse manner.

Figure 7:
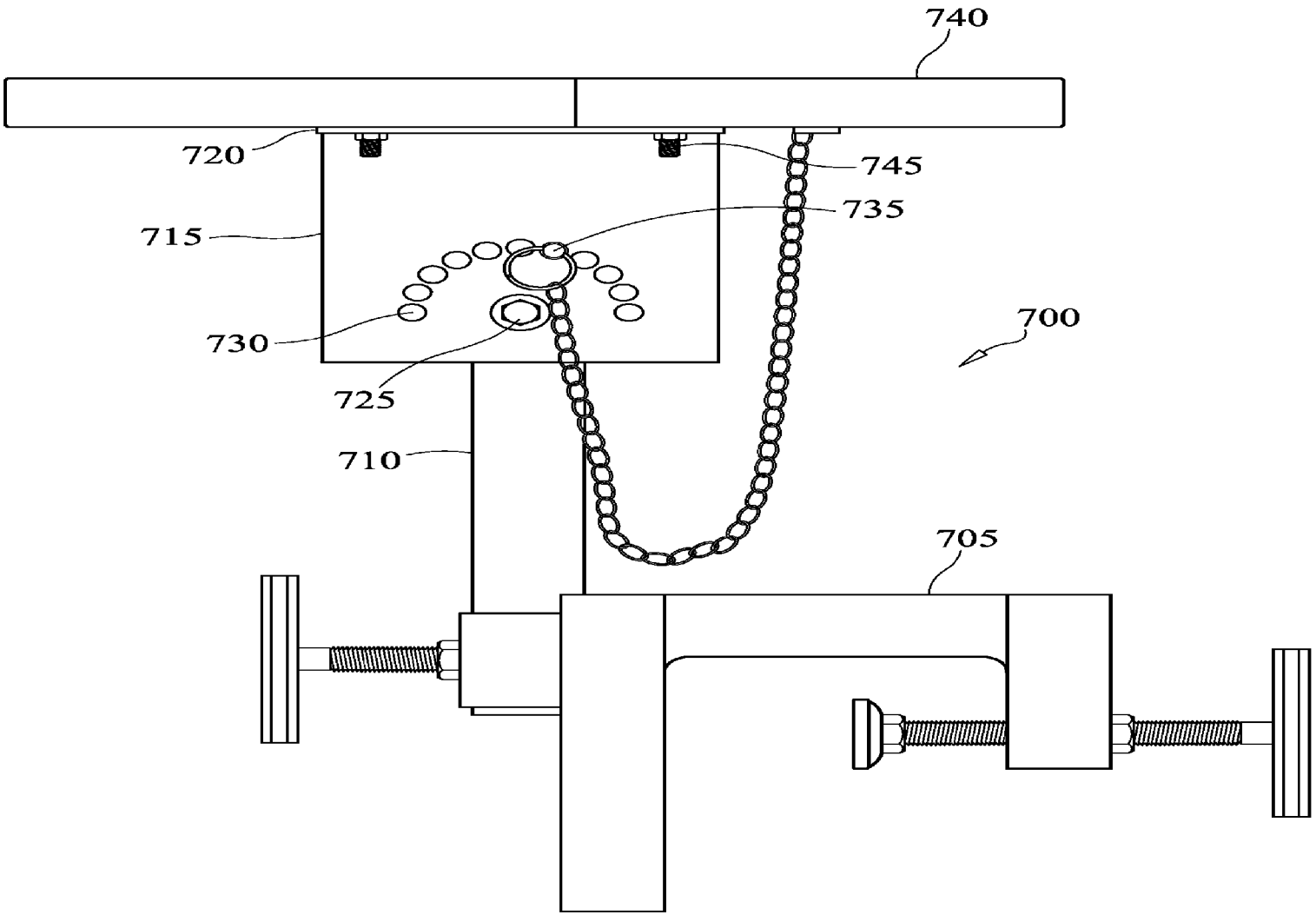
FIG. 7 illustrates a side elevation view of an alternative embodiment of the present invention.

Turning now to FIG. 7, In one embodiment, a modified frame may be utilized to serve as a checkpoint mount. In this embodiment, checkpoint mount 700 generally has a frame having a clamp member 705, which has a hand-screw and clamping element permitting clamp member 705 to be reversibly affixed on a structure such as a cement barricade.

Riser member 710, having a hand-screw, has a first end and second end. Riser member 710 may slidingly engage clamp member 705 and may be fixable thereupon where hand-screw is tightened to secure the riser's position relative to clamp member 705. Riser member 710 is shaped to define a plurality of riser locking apertures. Mounting platform 715 has a seating surface 720, and platform 715 is pivotally coupled to the second end of riser 710 by pivot point 725 making platform 715 rotatable 180 degrees in a plane perpendicular to riser 710. Mounting platform 715 is shaped to define a plurality of locking platform apertures 730, allowing locking apertures and platform locking apertures 730 to align during rotation of platform 715. Locking pin 735 is capable of reversibly inserting into riser and platform 730 locking apertures, whereupon platform 715 is locked into position. Mounting surface 740 is coupled to seating surface 720, by countersunk bolts 745. Mounting surface 740 may accommodate an array housing containing an array of firing cartridges. In one embodiment, multiple housing units may be used together. For example, three SHOCKWAVE units, each housing 6 cartridges, may be attached to each other and mounted on mounting platform 715. This would permit firing of 18 cartridges simultaneously.

Further disclosed is a method to convert a stationary or vehicle-mounted electric discharge weapon from a fixed status to a hand-carried status. A multi-cartridge electric discharge weapon, such as the SHOCKWAVE manufactured by Taser, Inc., is provided. The weapon system has a fire control unit having a fire button, and a plurality of firing cartridges which simultaneously fire when the fire button is depressed and the safety mechanism is disengaged. A multi-cartridge electric discharge weapon, such as the SHOCKWAVE has a housing that contains the plurality of firing cartridges. As is customary with the use of such weapons, it is set up in a fixed in a location—assembled with provided legs and stood in a location of interest, or disposed on a vehicle mount.

A hand-holdable apparatus 5 is provided which has a frame 10, at least one handle 30 coupled to frame 10, and a mounting plate 70 coupled to said frame. A fire control housing 50 is affixed to said frame, wherein said fire control unit may be at least partially disposed within said fire control housing 50, wherein the fire button is accessible through the fire control housing. The mounting plate 70 can accommodate the available housing containing the plurality of firing cartridges from a unit such as the SHOCKWAVE and the available housing may be reversibly attached to mounting plate 70

Next, the multi-cartridge electric discharge weapon is removed from its fixed location. In some circumstances this includes removing provided legs attached to the unit, in other circumstances, the weapon is detached from the vehicle mount. Next, the fire control unit is mounted in fire control housing 50, and next the housing containing the plurality of firing cartridges is mounted on mounting plate 70. The hand-holdable apparatus 5 may be carried, aimed, and fired as a rifle and used to subdue one or more subjects.

The disclosed method of utilizing hand-held apparatus 5 with attached weapon system may provide a greater firing accuracy, increased probability of striking a single subject, permits a single officer to subdue a number of subjects, serves a force multiplier, and overall permits a safer and more refined application of force.

It should be noted that various embodiments of the present invention may be applied in a variety of fields. While reference has been made to law enforcement applications, the apparatus may be utilized in any circumstances where subdual of a human or animal subject is desired. Some example applications include but are not limited to: law enforcement, corrections, veterinary medicine, animal control, as well as a variety of military and paramilitary applications.

Although the present invention has been described with reference to the preferred embodiments, it should be understood that various modifications and variations can be easily made by those skilled in the art without departing from the scope and spirit of the invention. Accordingly, the foregoing disclosure should be interpreted as illustrative only and is not to be interpreted in a limiting sense. It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

I claim:

1. A hand-holdable tactical apparatus for mounting and making hand-carriable a multi-cartridge firing electric discharge weapon, comprising:

a frame having a first end and second end, said frame shaped to define a rail on at least one surface, wherein said rail may accept accessories fitted thereupon, wherein said frame is shaped to define a fire control housing recess;

at least one handle having a grip surface and a coupling surface, wherein the coupling surface is adapted to slidably fit on said rail, wherein said coupling surface has a locking means to permit said handle to engage said rail, wherein said locking means, when engaged, prevents further movement on said handle;

a fire control housing, having a body and a cover, wherein the body is affixed to said fire control housing recess, said cover securable to said body; wherein said fire control housing is configured to contain a fire control unit of a multi-cartridge firing electric discharge weapon;

a mounting plate coupled to the second end of said frame, wherein said mounting plate is configured to attach to an array housing unit of a multi-cartridge firing electric discharge weapon containing an array of firing cartridges;

wherein said fire control housing is shaped to define a fire button aperture, a safety arming switch aperture, a charge lamp aperture, a re-energize lamp aperture, and a go lamp aperture, wherein said fire control unit is a SHOCKWAVE fire control unit, said SHOCKWAVE fire control unit having a fire button, a safety arming switch, a charge lamp, a re-energize lamp, and a go lamp, wherein said fire button aperture, safety arming switch aperture, charge aperture, re-energize aperture, and go aperture correspond to the fire button, safety arming switch, charge lamp, re-energize lamp, and go lamp of the SHOCKWAVE fire control unit;

wherein said mounting plate is downwardly sloped 4 degrees, wherein said mounting plate is shaped to define mounting apertures, an annular spacer, wherein said spacer is disposed upon said mounting plate, further comprising a bolt passing through spacer and mounting aperture, wherein an array housing of a SHOCKWAVE multi-cartridge firing electric discharge weapon may be secured to said mounting plate by said bolt, wherein the mounting bracket is boltably affixed to said mounting plate.

* * * * *